United States Patent [19]

Kasiewicz

[11] 4,372,265

[45] Feb. 8, 1983

[54] CONTROL CIRCUIT FOR ENGINE SPEED GOVERNOR WITH POWER TAKE OFF

[76] Inventor: Stanley J. Kasiewicz, 1807 Harvest La., Bloomfield Hills, Mich. 48013

[21] Appl. No.: 167,964

[22] Filed: Jul. 14, 1980

[51] Int. Cl.[3] ..... F02D 11/10

[52] U.S. Cl. ..... 123/352; 123/353; 123/361; 180/179; 180/174

[58] Field of Search ..... 123/352, 353, 361; 180/179, 176, 174

[56] References Cited

U.S. PATENT DOCUMENTS

| | | | |
|---|---|---|---|
| 3,722,485 | 3/1973 | Ohtani | 123/352 |
| 3,722,614 | 3/1973 | Sakakibara | 180/179 |
| 3,885,644 | 5/1975 | Seidler | 123/352 |
| 4.090,480 | 5/1978 | Kasiewicz | 123/361 |
| 4,181,103 | 1/1980 | Sturdy | 123/352 |
| 4,188,926 | 2/1980 | Fleischer | 123/352 |
| 4,245,599 | 1/1981 | Des Lauriers | 123/353 |

*Primary Examiner*—Ronald B. Cox

*Attorney, Agent, or Firm*—Reising, Ethington, Barnard, Perry & Brooks

[57] ABSTRACT

A control circuit for a speed governor is disclosed which provides governing action of one type for operation in a normal engine speed governing mode and governing action of a different type for engine operation in a power take off (PTO) mode. In the normal mode, the throttle control means is actuated between wide open throttle and a close throttle reference position. In the PTO mode the throttle control means is actuated between an open throttle reference position and the close throttle reference position. An overspeed sensing circuit is operative to allow the throttle control means to be driven past the close throttle reference position in an overspeed condition. A PTO selector switch is provided which is operative to provide different governed speeds for the PTO and normal modes. A PTO initiating circuit causes the throttle control means to be driven to the close throttle reference position and it operatively connects an oscillator circuit with the logic means to modulate the motor energization and thereby operate the motor at reduced speed in the PTO mode.

10 Claims, 3 Drawing Figures

CONTROL CIRCUIT FOR ENGINE SPEED GOVERNOR WITH POWER TAKE OFF

TECHNICAL FIELD

This invention relates to speed governors for engines and more particularly it relates to an electronic control circuit for a speed governor for engines having a power take off.

BACKGROUND ART

Engine speed governors are commonly used on internal combustion engines in many different applications. Typical applications are for vehicle engines of trucks and buses. As is well known, speed governors are employed for the purposes of limiting operating speeds and for protecting the engines from damage due to overspeed.

Combined engine and load speed or road speed governors have been developed which are responsive to both engine speed and vehicle speed for controlling or limiting the engine speed. A governor of this type is disclosed in U.S. patent application Ser. No. 036,064 filed by Harry D. Sturdy on May 4, 1979. An electronic control circuit especially adapted for a governor of the type disclosed in said patent application is disclosed and claimed in my U.S. Pat. No. 4,090,480 granted May 23, 1978 and in my patent application Ser. No. 047,544 filed June 11, 1979.

In certain types of vehicles, such as dump trucks and garbage trucks, the engine is provided with a power take off (PTO) for driving an auxiliary load. In such vehicles it is desirable to provide an engine speed governing function especially adapted for the PTO operation. In particular, it is desirable to provide speed governing with a higher degree of accuracy and to provide control which will prevent damage to the power train of the vehicle.

A general objective of this invention is to provide an electronic control circuit for an engine speed governor which is especially adapted for governing an engine having a power take off.

SUMMARY OF THE INVENTION

In accordance with this invention, a governor control circuit provides governing action of one type for operation in a normal engine speed governing mode and governing action of a different type in a PTO mode. In the PTO mode, the speed is controlled within a narrow speed range and with a higher degree of accuracy.

This is accomplished by a system in which the throttle control means is actuated by a reversible motor with switching means for energizing the motor in either the close or open throttle directions; logic means responsive to speed sensing means is provided for controlling the switching means according to a set value of governed speed.

In the normal mode, the throttle control means is actuated between wide open throttle and a close throttle reference position; in the PTO mode, the throttle control means is actuated between an open throttle reference position and close throttle reference positions.

A close throttle switching means deenergizes the motor when it reaches the close throttle reference position and an open throttle switching means deenergizes the motor when it reaches an open throttle reference position. Accordingly, in the PTO mode, the throttle control means is actuated between predetermined limits. When an overspeed condition occurs, means are provided to disable the close throttle switching means and permit the throttle control means to be driven past the close throttle reference position. A PTO selector switch is provided to initiate operation of the control circuit in the PTO mode. The system includes an oscillator coupled with the logic means for modulating the energization of the motor for operation at a reduced speed. The selector switch is coupled with the speed sensing circuit and logic means to set a reduced governed speed for the PTO mode. A PTO initiating circuit is responsive to the selector switch and is coupled with the logic means to cause the motor to be energized in the close throttle direction; it also delays the output of the oscillator so that the motor is energized at full speed until the close throttle reference position is reached.

Also, a control circuit for a speed governor is provided with an oscillator having means for changing its duty cycle according to the state of the logic means. It also includes means to vary the duty cycle in inverse relationship with the change of supply voltage to the oscillator and the motor.

A more complete understanding of the invention may be obtained from the detailed description that follows taken with the accompanying drawings.

BEST MODE FOR CARRYING OUT THE INVENTION

Figure 1:
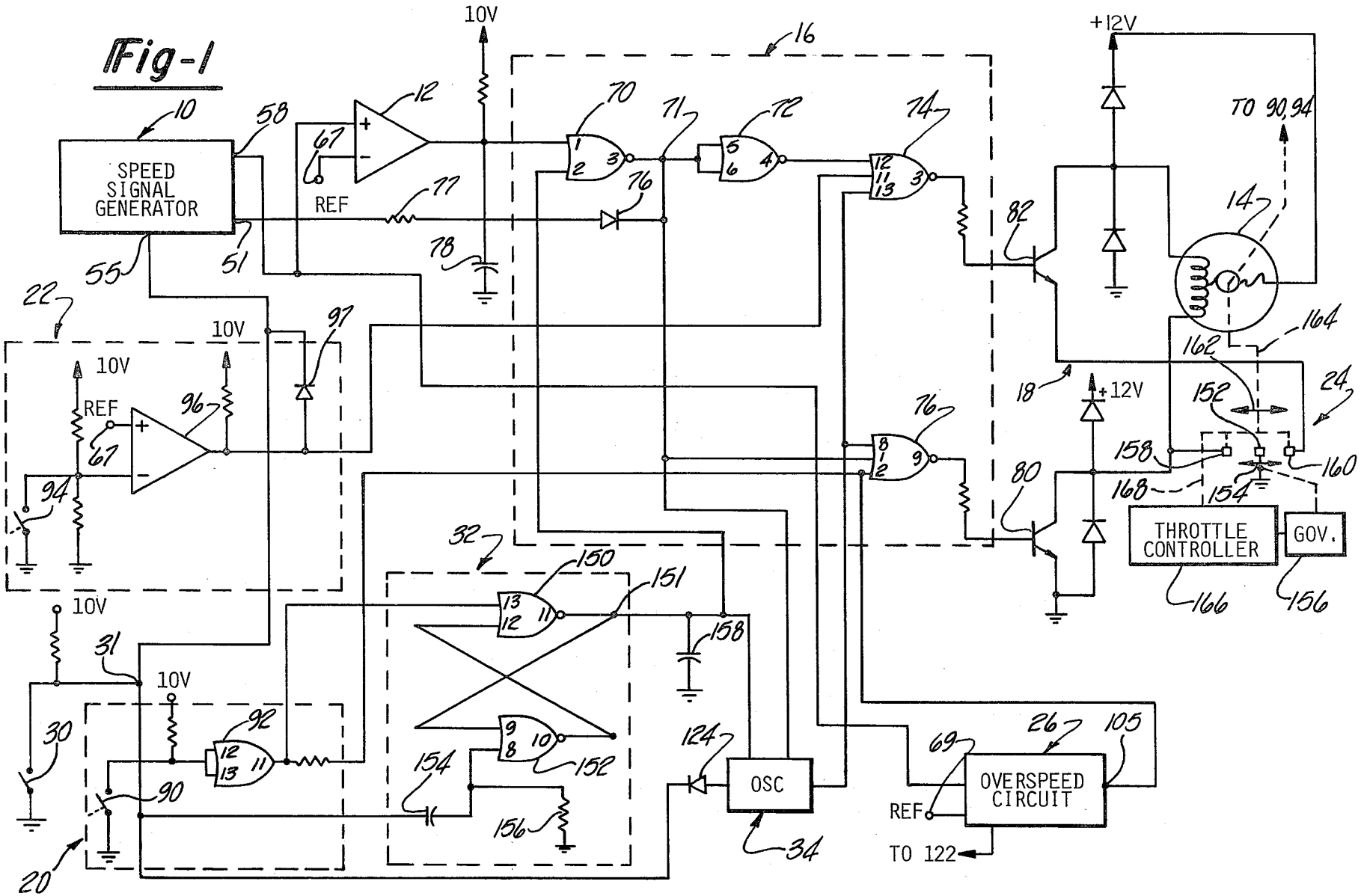
FIG. 1 is a schematic and block diagram of the control circuit of this invention.

Referring now to the drawings, an illustrative embodiment of the invention is shown in a control circuit especially adapted for use with a combined engine and road speed governor for vehicles. The control circuit of this invention is adapted for operation in an engine speed governing mode (normal mode) and also in a power take off engine speed control mode (PTO mode). This control circuit operates in conjunction with a load speed (i.e. vehicle road speed) governor of the type disclosed and claimed in the U.S. patent application Ser. No. 036,064 filed by Harry D. Sturdy on May 4, 1979 entitled "Engine Governor with Reference Position For Throttle Limiter". The control circuit is adapted for either spark ignition engines or diesel engines.

In general, as shown in FIG. 1, the circuit comprises a speed signal generator 10 which develops an analog speed voltage corresponding to the value of engine speed. The output of the speed signal generator is coupled with an engine speed comparator 12 which develops a logic signal for use in controlling a throttle positioning motor 14. The logic signal from the comparator 12 is applied to a logic circuit 16 which controls the energization of the motor 14. The output of the logic circuit 16 is applied to the motor energizing circuit 18. The motor energizing circuit 18 includes a transistor 80 which is connected with the close throttle winding of the motor 14 for energizing the motor in the close throttle direction when the transistor is turned on. The energizing circuit also includes a transistor 82 which is connected with the open throttle winding of the motor 14 through a switch 24 for energizing the motor in the open throttle direction when the transistor 82 is turned on. A close throttle switching circuit 20 supplies an input signal to the logic circuit 16 according to throttle position. Similarly, an open throttle switching circuit 22 supplies an input signal to the logic circuit 16 according to throttle position. A power supply circuit 24 (see FIG. 2) receives the vehicle battery voltage and supplies a regulated output voltage for the integrated circuits. The system thus far described is operative in the normal engine speed governing mode.

The close throttle switching circuit 20, referred to above, includes a normally open switch 90 which is closed when the motor reaches a close throttle reference position. The open throttle switching circuit 22, referred to above, includes a normally open switch 94 which is closed when the motor 14 reaches an open throttle reference position; this circuit is disabled when operating in the normal mode. In the normal mode, the motor is operated between the close throttle reference position and wide open throttle.

The system also includes a PTO selector switch 30 and a PTO initiating circuit comprising a flip-flop 32 for selecting the PTO mode. In the PTO mode, the open throttle switching circuit 22 is enabled and the motor is operated between the close throttle and open throttle reference positions. An oscillator circuit 34 is turned on by the PTO selector switch 30 and provides an output to the logic circuit 16 to modulate the energization of the motor 14 in the PTO mode so that the motor is operated at a reduced speed. When the PTO switch is opened to initiate the PTO mode the flip-flop 32 is set and a signal is supplied to the logic circuit 16 to cause the motor 14 to be driven in the close throttle direction. The output of the flip-flop is also applied to the oscillator circuit 34 to disable the oscillator and allow fast movement of the motor to the close throttle reference position. When the close throttle reference position is reached the close throttle switching circuit 20 applies a reset signal to the flip-flop which changes state. In the reset state, the flip-flop does not disable the oscillator and does not cause the motor to be energized.

An overspeed circuit 26 is used in the engine speed governing mode and the PTO mode. The overspeed circuit receives the speed signal from the engine speed signal generator 10 and provides an overspeed signal to the logic circuit 16. When the speed is excessive (and remains excessive for a few seconds) the overspeed signal is effective to override the close throttle switching circuit 20 and allows the motor to drive the throttle beyond the close throttle reference position.

Before describing details of the control circuit, it will be helpful to consider the relationship of the subject control circuit with the road speed governor with which it is usable. The motor energizing circuit 18 includes a switch 24 (see FIG. 1). The switch 24 is part of a speed governing device which, per se, forms no part of the present invention. The switch comprises a center contact 152 which is movable over a limited range of distance in the direction indicated by the arrow 154. The movement of the contact 152 is caused by a flyball governor 156 responsive to vehicle speed. The switch 24 also comprises a pair of movable contacts 158 and 160 which are movable concurrently in the direction indicated by the arrow 162. The contacts 158 and 160 are moved by the motor 14 through a suitable control linkage 164. A throttle controller 166 is connected to the linkage 164 and is also connected to the governor 156 through a linkage 168. The range of movement of the contacts 158 and 160 is somewhat greater than the range of movement of the center contact 152 so that under certain operating conditions the contact 152 is not closed against either contact 158 or 160. When the motor 14 is energized for close throttle rotation, the contacts 158 and 160 are moved in the left direction and this movement of the throttle control linkage 164 causes the throttle controller 166 to actuate the throttle toward the closed position. When the motor is energized for open throttle rotation the movable contacts 158 and 160 are moved to the right and the throttle control linkage 164 is actuated in a direction which causes the throttle controller 166 to enable increased opening of the throttle.

As noted above, the motor 14 is energized for rotation in the close throttle direction when the transistor 80 is turned on. This energization of the motor is independent of the switch 24. However, the motor may also be energized for close throttle rotation, with transistor 80 turned off, by closure of contact 152 against contact 158 under control of governor 156. The energization of the motor in the open throttle direction depends upon the switch 24 and the transistor 82. When the switch contacts 152 and 160 are closed and the transistor 82 is turned on, a circuit is completed from the voltage source through the open throttle winding and thence through the transistor 82 to the switch contacts 160 and 152 to ground.

The circuit will now be described in greater detail with reference to FIGS. 1 through 5.

Figures 2, 3:
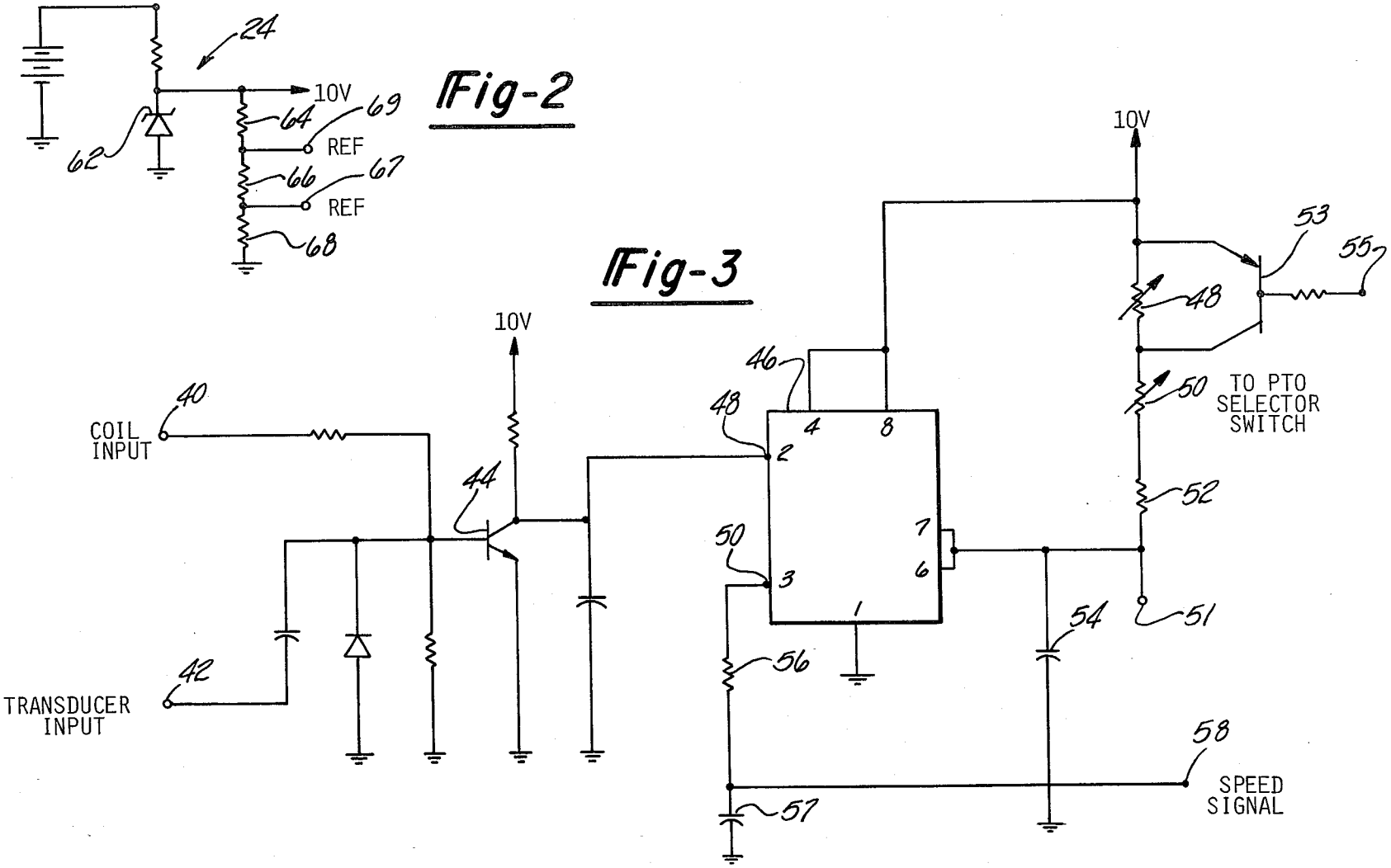
FIG. 2 is a schematic diagram of the power supply.
FIG. 3 is a schematic diagram of the speed signal generator.

The speed signal generator 10, shown in FIG. 3, develops an analog voltage which is porportional to engine speed. For this purpose, the generator 10 is adapted to receive engine ignition coil impulses on coil input 40 from the primary winding of ignition coil of a spark ignited engine. It is also adapted to receive transducer impulses on transducer input 42 from a transducer coupled with the crankshaft of a diesel engine. The speed signal generator 10 is comprised of a frequency-to-voltage converter circuit. The circuit includes an input transistor 44 which is coupled to a monostable multivibrator (one-shot) 46. The one-shot comprises an integrated circuit and has an external timing circuit including variable resistors 48 and 50 and fixed resistor 52 in series with a timing capacitor 54 across the regulated supply voltage, 10 V. Variable resistors 48 and 50 may be adjusted to set the governed speed of the engine at a desired value for both the engine speed governing mode and the PTO mode. A switching transistor 53 has its output connected in parallel with the variable resistor 48 and an input terminal 55 connected to the output terminal 31 of selector switch 30. When the selector switch is in the closed position to select the engine speed governing mode, the transistor 53 is turned on and the resistor 48 is bypassed to set the governed speed. When the selector switch 30 is opened to select the PTO mode, the transistor 53 is turned off and resistor 48 remains in the timing circuit and sets a lower governed speed. The operation of the speed signal generator will be described for an ignition engine with the ignition pulses applied to the coil input 40. (The operation of the circuit will be the same for diesel engine with transducer pulses applied to the transducer input 42.) The input pulses on the input 40 are applied through the input circuit to the base of the transistor 44 and each pulse turns on the transistor. The output of the transistor 44 is applied to the input terminal 48 of the one-shot 46, and each pulse triggers the one-shot circuit. Each time the circuit is triggered, the output terminal 50 of the one-shot will be high for a certain length of time depending upon the time constant of the timing circuit. The output 50 is connected across the resistor 56 and capacitor 57 which is charged to a voltage value corresponding to the engine speed. An analog speed signal is developed on a terminal 58 and is applied to the signal input of the comparator 12 which will be described below.

The speed comparator 12 (see FIG. 1) is adapted to develop a speed logic signal in response to the analog speed signal from the speed signal generator 10. For this purpose, the speed signal from the terminal 58 is applied to the noninverting input (signal input) of the comparator 12. A reference voltage which represents the desired governed speed is applied to the inverting input (reference input) of the comparator 12. The reference voltage is derived from the regulated voltage of power supply 24. As shown in FIG. 2, the batter voltage is applied across a series resistor 60 and a zener diode 62 to obtain a regulated voltage for use with the integrated circuits. The regulated voltage is applied across a voltage divider string of resistors 64, 66 and 68. The reference voltage for the comparator 12 is taken from the junction 67 of resistors 66 and 68 and applied to the reference input of the comparator. When the speed signal voltage on the signal input of the comparator is less than the reference voltage, the output of the comparator is at logic low and when the speed signal voltage is higher than the reference voltage the output of the comparator is at logic high. A speed logic signal is developed at the output of the comparator 12 and applied to the input of the logic circuit 16. When the engine speed is decreasing, it may be desirable to have the speed comparator 12 switch to a logic low output at an engine speed which is somewhat lower than that at which it switches to a logic high output when the engine speed is increasing. This allows small speed variation within a narrow band around the governed speed without switching of the comparator. For this purpose, the comparator 12 is provided with a hysteresis band in a manner which will be described in connection with the logic circuit 16.

The logic circuit 16 comprises a NOR gate 70 which receives the speed logic signal on a first input and receives a logic signal from the flip-flop 32 on a second input. For purposes of the present description, it will be assumed that the output of the flip-flop 32 is at logic low (which is the case during operation in the engine speed governing mode). The logic circuit also comprises an inverter 72 and a pair of NOR gates 74 and 76. The output 71 of the NOR gate 70 is applied to a first input of the NOR gate 76 and it is also applied through the inverter 72 to a first input of the NOR gate 74. The NOR gate 76 is adapted to control the energization of the motor 14 in the close throttle direction through the motor energizing circuit 18. The NOR gate 76 receives a signal from the close throttle switching circuit 20 on a second input. It also receives an input from the oscillator 34 on a third input. The output of the NOR gate 76 is applied to a first input of the motor energizing circuit 18 which will be described below. The NOR gate 74 is adapted to control the energization of the motor 14 in the open throttle direction. This NOR gate receives a signal from the open throttle switching circuit 22 on a second input of the NOR gate. The NOR gate also receives the output of the oscillator 34 on a third input. The output of the NOR gate 74 is connected to a second input of the motor energizing circuit 18, which will be described below.

In order to provide hysteresis switching for the comparator 12, as referred to above, the output of the NOR gate 70 is connected through a feedback circuit to the reference input of the comparator 12. This feedback circuit includes a diode 76 and a resistor 77. When the output of the NOR gate 70 goes to logic low, current is bled from the capacitor 54 so that the voltage at the reference input is reduced slightly to change the switching point.

The motor energizing circuit 18 comprises a power transistor 80 which has its input connected with the output of the NOR gate 76. The output of the transistor 80 is connected with the close throttle winding of the motor 18 for energizing the motor in the close throttle direction. The energizing circuit 18 also includes a power transistor 82 which has its input connected with the output of the NOR gate 74. The output of the transistor 82 is connected with the open throttle winding of the motor 14 through a switch 84.

The close throttle switching circuit 20 comprises a pair of normally open switch contacts 90 connected with the input of an inverter 92. The switch contacts 90 are closed when the motor 14 reaches the close throttle reference position. When the contacts are closed, the input of the inverter is connected to ground to produce a logic low at the input and a logic high at the output of the inverter. The output of the inverter is applied to the second input of the NOR gate 76. The switch contacts 90 are open before the motor reaches the close throttle reference position and the output of the inverter 92 is at logic low. In this condition, the output of the inverter does not affect the state of NOR gate 76. However, when the switch contacts 90 are closed the output of the inverter 92 goes to logic high and the output of the NOR gate 76 goes to logic low. This turns off the transistor 80 and deenergizes the close throttle winding of the motor.

The open throttle switching circuit 22 comprises a switch 94 which is normally open and which is closed when the motor 14 reaches the open throttle reference position; however, the circuit is disabled when the PTO selector switch is closed, as will be described below. The switch 94 is connected between ground and one input of a comparator 96, which is connected to function as an inverting circuit. For this purpose the other input of the comparator 96 is connected with a reference voltage taken from the junction 67 of resistor 66 and 68 in the power supply 24. The output of the comparator 96 is connected with the second input of the NOR gate 74. The output of the comparator may be connected to ground through a diode 97 and PTO selector switch 30. When the PTO selector switch 30 is closed (as in the normal mode) the output of the comparator 96 is at logic low, regardless of switch 94, and it has no effect on the NOR gate 74. When the selector switch 30 is open (PTO mode), and the switch 94 is closed the output of the comparator 96 goes to logic high and the output of the NOR gate 74 goes to logic low. This turns off the transistor 82 and deenergizes the open throttle winding of the motor 14.

Figure 5:
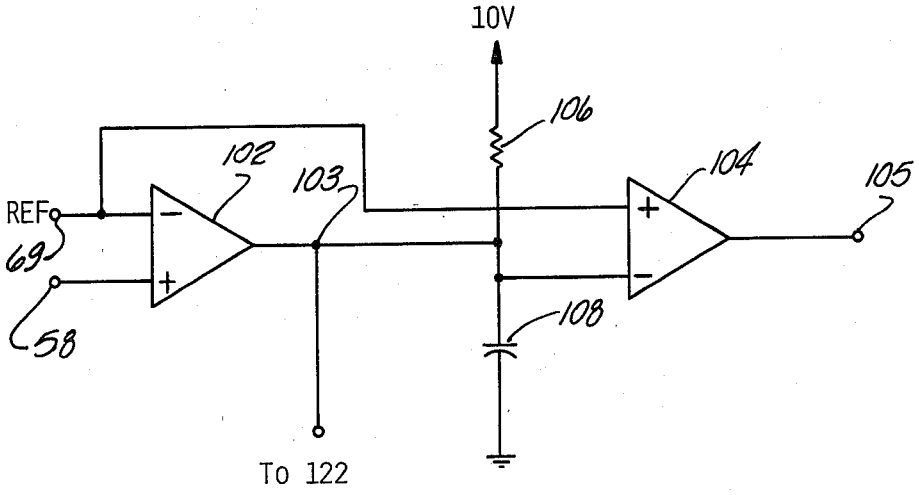
FIG. 5 is a schematic diagram of the overspeed circuit.

The overspeed circuit 26, shown in FIG. 5, comprises a comparator 102 and a comparator 104 which are adapted to respond to an engine overspeed condition and cause the motor 14 to be energized in the close throttle direction to an extent greater than the close throttle reference position. The comparator 102 has a signal input (non-inverting) connected with the terminal 58 to receive the speed signal voltage. The reference input (inverting input) is connected to a reference voltage taken from the junction 69 of resistor 64 and 66 in the power supply 24. Note that the overspeed reference voltage is at a higher level than the governed speed reference voltage. The output 103 of the comparator 102 is connected with the signal input (inverting input) of the comparator 104. The output of comparator 102 is also connected to the regulated voltage source through a resistor 106 and to ground through a capacitor 108. The reference input (non-inverting input) of the comparator 104 is connected with the reference voltage at the junction 69 of resistor 64 and 66. Accordingly, when the speed signal voltage at the signal input of comparator 102 exceeds the reference voltage, the output of the comparator 102 goes to logic high and the capacitor 108 starts to charge through resistor 106. When the voltage across the capacitor 108 exceeds the reference voltage on the reference input of comparator 104, the output of the comparator 104 goes to logic low. The charging time required for the capacitor 108 to exceed the reference voltage is approximately five seconds. The output 105 of the comparator 104 is connected to the second input of the NOR gate 76 (see FIG. 1). When the output of the comparator 104 is at logic low, it overrides the effect of the logic signal applied from the switch 90 through inverter 92 to the second input of the NOR gate 76. This allows the motor 14 to drive the throttle to a closed position beyond the close throttle reference position.

Figure 4:
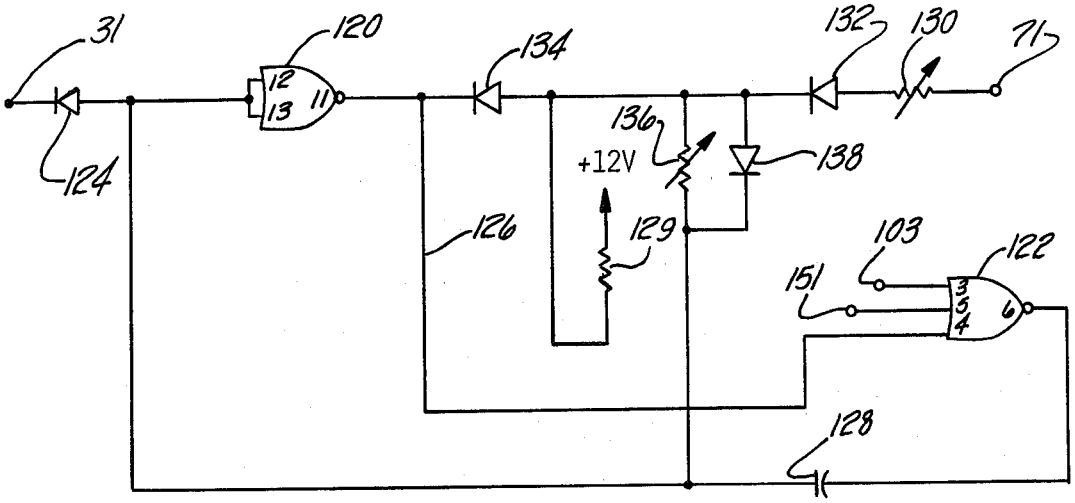
FIG. 4 is a schematic diagram of the oscillator circuit.

The oscillator circuit 34, shown in FIG. 4, is adapted to produce a square wave output with an adjustable duty cycle for modulating the energization of the motor 14 when the control circuit is operated in the PTO mode. For this purpose, the output of the oscillator, as will be described, is connected to respective inputs of the NOR gates 74 and 76. The oscillator is turned off by the PTO selector switch 30 when it is in the closed position and it is turned on with the switch in the open position. The oscillator circuit comprises an inverter 120 and a NOR gate 122. The input of the inverter 120 is connected through a diode 124 to the terminal 31 of the PTO selector switch 30. When the PTO selector switch is closed, the input of the inverter is connected to ground and the oscillator is turned off. The output of the inverter 20 is connected through a conductor 126 to a first input of the NOR gate 122. The output of the NOR gate 122 is connected through a capacitor 128 to the input of the inverter 120. The battery voltage, +12 v., is connected to the capacitor 128 through a charging circuit including a resistor 129 and a diode 138. Also, the capacitor 128 may be charged through an auxiliary charging circuit which extends from the output of the NOR gate 70 in logic circuit 16 through a resisotr 130 and diode 138 to the capacitor. A diode 134 is connected between the resistor 129 and the output of the inverter 120. A discharge circuit for the capacitor 128 extends through a resistor 136 and the diode 134 to the output of the inverter 120. The value of resistor 129 in the charging circuit for capacitor 128 is much lower than that if resistor 136 in the discharging circuit so that the duty cycle of the oscillator is about 15 to 20 percent under operating conditions in which there is no charging current through resistor 130. Under certain conditions, the duty cycle is altered, as will be described below. The NOR gate 122 has a second input which is connected with the output 103 of the comparator 102 in the overspeed circuit. When the output of the comparator 102 is high, the NOR gate 122 is inhibited and stops oscillation of the circuit. A third input of the NOR gate 122 is connected with the output 151 of the flip-flop circuit 32 so that the output of the NOR gate 122 is inhibited and the oscillator is stopped when the flip-flop is set, as will be described further below. When the PTO selector switch 30 is in the open position to select the PTO mode of operation, the oscillator 34 is operative to produce a train of output pulses on the output of the NOR gate 122. This output is applied through a conductor 140 to the third input of the NOR gate 76 and the third input of the NOR gate 74. This has the effect of modulating the drive current to the motor 14, i.e. it reduces the average value of the input current and causes the motor to operate at reduced speed which permits high accuracy in positioning the motor and more nearly matches the motion of the motor to the response time of the engine.

The oscillator circuit 34, as just described, is adapted to operate with a duty cycle which provides different motor energization in the close throttle direction than for motor energization in the open throttle direction. The reason for this arises because the throttle control linkage is spring-loaded; in order to obtain the same motor speed in both directions, higher motor torque is required when actuating the throttle control in a direction against the spring load. This is obtained as follows. In operation of the oscillator, the ON time of the oscillator is determined by the time constant of the charging circuit of capacitor 128 which, in turn, is determined by the value of resistor 129. This determines the time required to charge the capacitor 128 to a logic high value which will change the output state of the inverter 120 from logic high to logic low. The OFF time of the oscillator is determined by the time constant of the discharge circuit which, in turn, is determined by the value of the resistor 136. The OFF time continues until the capacitor 128 is discharged to a logic low level which causes the output of the inverter 120 to go to logic high. When the auxiliary charging circuit through resistor 130 is effective, the ON time of the oscillator is reduced. This occurs when the output 71 of the NOR gate 70 is at logic high, a condition which causes the motor to be energized in the open throttle direction. When the output 71 is at logic high, the capacitor 128 is charged through resistor 130 in parallel with the charging circuit through resistor 129 and the capacitor 128 is charged to a logic high voltage in less time than when the output 71 is at logic low. Accordingly, when the logic circuit 16 calls for energizing the motor in the open throttle direction the ON time and hence the duty cycle of the oscillator, is reduced so that the torque delivered by the motor is reduced as compared to that which obtains when the logic circuit 16 calls for energizing the motor in the close throttle direction. Thus, the operating speed of the motor in the close throttle direction is substantially the same as that for the open throttle direction.

The oscillator circuit 34 is also adapted to operate with a duty cycle which varies inversely with the supply voltage to the oscillator. This is provided because the battery voltage of the vehicle varies over a relatively wide range and the motor 14 runs at a speed which varies directly with motor supply voltage. As noted above, the oscillator is supplied with the battery voltage, +12 v., which is the nominal voltage for the vehicle battery but in actual practice, the battery voltage may vary from 9 volts to over 14 volts. The logic gates 120 and 122 are supplied with a regulated voltage from the power supply 24. Accordingly, when the battery voltage is at a higher value, the capacitor 128 is charged at a faster rate than when the battery voltage is at a lower value. Thus the higher battery voltage produces a shorter ON time for the oscillator while the OFF time remains constant. This results in shorter duration pulses being applied to the motor (i.e. lower duty cycle) which offsets the higher amplitude of the supply voltage to the motor so that the motor will run at constant speed, regardless of supply voltage variations.

The flip-flop circuit 32, shown in FIG. 1, is adapted to initiate the operation of the control circuit in the PTO mode in response to opening of the PTO selector switch 30. Tthe flip-flop circuit 32 comprises a pair of cross-coupled NOR gates 150 and 152. The output 31 of the PTO selector switch 30 is connected to a first input of the NOR gate 152 through a capacitor 154 and across a resistor 156. The second input of the NOR gate 152 is coupled with the output 151 of NOR gate 150. The output of the NOR gate 152 is coupled with a first input of the NOR gate 150 and the second or reset input of the NOR gate 150 is connected with the output of the inverter 92 in the close throttle switching circuit 20. The output 151 of the NOR gate 150 is connected across a capacitor 158 and to the second input of the NOR gate 70 in the logic circuit 16. The output of the NOR gate 150 is also connected to the third input of the NOR gate 122 in the oscillator 34. When the PTO selector switch 30 is opened, the set input of the flip-flop 152 goes to logic high and the output thereof goes to logic low. This causes the output 151 of NOR gate 150 to go to logic high. The high output from the NOR gate 150 is applied to the third input of the NOR gate 122 and disables the oscillator. This allows the motor to drive at full speed to the close throttle reference position. The high output of NOR gate 150 is also applied to the second input of the NOR gate 70 which causes its output 71 to go to logic low. This causes the output of NOR gate 76 to go to logic high and the transistor 80 is turned on to energize the motor in the close throttle direction. When the motor reaches the close throttle reference position, the switch 90 is closed and the output of the inverter 92 goes to logic high. The output of the inverter 92 is applied to the reset input of the NOR gate 150 and the flip-flop is reset with the output 151 at logic low. Resetting the flip-flop causes the transistor 80 to turn off and allows the oscillator 34 to run.

With the PTO selector switch in the closed position, the system operates in the engine speed governing mode. A speed signal is developed by the signal voltage generator 10 at the output 58 and is applied to the signal input of the comparator 12. The governed speed is established by the reference voltage at junction 67 which is applied to the reference input of the comparator 12. When the engine speed is below the governed speed, the output of the comparator 12 is at logic low. This causes the output of the NOR gate 70 to be at logic high and the output of NOR gate 74 to be at logic high. This causes the transistor 82 to turn on and, assuming the contacts 152 and 160 of switch 84 are closed, the motor is energized in the open throttle direction. Since the open throttle switching circuit 22 is disabled by grounding of the output of comparator 96 through switch 30, closing of switch 94 when the motor reaches the open throttle reference position has no effect on the motor energizing circuit. Accordingly, the throttle control means may be driven past the reference position toward wide open throttle. When the engine speed signal voltage is higher than the reference voltage, the output of the comparator 12 is at logic high. This causes the output of NOR gate 70 to go to logic low and the output of the NOR gate 76 to go to logic high. This turns on the transistor 80 which energizes the motor in the close throttle direction. When the motor reaches the close throttle reference position the switch 90 is closed and the output of inverter 92 goes to logic high. This causes the output of the NOR gate 76 to go to logic low and the transistor 80 is turned off and the motor is deenergized. In this mode of operation, the engine speed is limited to a value near the governed speed by the operation of the motor between the close throttle reference position and the wide open throttle position. In the event that the engine reaches an overspeed condition, the output 105 of the overspeed circuit 26 goes to logic low and overrides the effect of the closure of close throttle switch 90 at the close throttle reference position. This causes the output of the NOR gate 76 to go to logic high which keeps the transistor 80 turned on to drive the motor to a closed throttle position which is beyond the close throttle reference position.

When the PTO selector switch 30 is opened, the operation of the control circuit in the PTO mode is initiated. The opening of the switch 30 is effective to set the flip-flop 32 so that the output 151 of NOR gate 150 thereof goes to logic high. This causes the output of NOR gate 70 to go to logic low and the output of NOR gate 76 to go to logic high turning on the transistor 80 and energizing the motor 14 in the close throttle direction. At the same time, opening of the switch 30 turns off the switching transistor 53 in the speed signal generator 10 and bypasses the resistor 48. This causes the signal generator 10 to produce a higher signal voltage on output 58 for the same engine speed for operation in the PTO mode. Also, the output of the flip-flop circuit 32 in the set condition disables the oscillator circuit 34. When the motor reaches the close throttle reference position, the switch 90 is closed and the output of the inverter 92 resets the flip-flop 32. Thus, the transistor 80 is turned off deenergizing the motor 14 and the oscillator 34 is enabled. With the PTO selector switch 30 open, the open throttle switching circuit 22 is enabled so that the output of comparator 90 goes to logic high when switch 94 is closed. In the PTO mode, the circuit operates to limit the engine speed to the governed value in the manner as described for the engine speed governing mode, except that the motor energization is modulated by the oscillator circuit 34 and the motor is operated between the open throttle reference position and the close throttle reference position. This mode of operation provides a high degree of accuracy in positioning of the throttle for control of the engine speed.

Although the description of this invention has been given with reference to particular embodiment, it is not to be construed in a limiting sense. Many variations of modifications of the invention will now occur to those skilled in the art. For a definition of the invention reference is made to the appended claims.

What is claimed is:

1. In a speed governing system for an engine having a throttle control means, said system being of the type including, a reversible motor adapted to be connected with the throttle control means for actuating the control means selectively in a close throttle direction and open throttle direction, speed sensing means adapted to be connected with said engine for developing a speed voltage corresponding to engine speed, first and second switching means for energizing said motor in the close throttle and open throttle directions respectively, logic means operatively coupled with the sensing means and said switching means for energizing the motor in a close throttle direction when the engine speed exceeds a first predetermined value and for energizing the motor in an open throttle direction when the engine speed is less than said first predetermined value, said system being characterized in that it includes, a mode selector switch for selecting a first or a second mode of operation, a close throttle switching means actuated by said throttle control means for deenergizing said motor when the throttle control means reaches a close throttle reference position, and an open throttle switching means actuated by said throttle control means for deenergizing said motor when the throttle control means reaches an open throttle reference position, disabling means operatively coupled with said open throttle switching means for disabling it, said mode selector switch being coupled with said disabling means to disable the open throttle switching means when the first mode of operation is selected whereby the motor is operative to actuate the throttle control means in the open throttle direction past the open throttle reference position to the wide open throttle position, said open throttle switching means being operative when the second mode of operation is selected to deenergize said motor when the throttle control means reaches said open throttle reference position.

2. The invention as defined in claim 1 wherein said first mode is an engine speed governing mode and said second mode is a power take off mode, said selector switch being operatively coupled with said speed sensing means and said logic means for setting the governed speed of the engine at a different value for the power take off mode than for the engine speed governing mode.

3. The invention as defined in claim 2 including an overspeed sensing circuit for producing an overspeed signal when the engine reaches a predetermined speed above said governed speed, said overspeed sensing circuit being coupled with said logic means and being operative to disable said close throttle switching means whereby said motor remains energized to actuate the throttle control means beyond the close throttle reference position toward a closed throttle position.

4. The invention as defined in claim 2 including an oscillator circuit operatively coupled with said logic means for modulating the energization of said motor whereby it is operated at reduced speed, said mode selector switch being operatively coupled with said oscillator circuit for applying the oscillator output to said logic means when the power take off mode is selected.

5. The invention as defined in claim 4 including an initiating circuit coupled with said mode selector switch for initiating operation in the power take off mode, said initiating circuit being coupled with said logic means for energizing said motor in the close throttle direction and being operatively coupled with said oscillator to delay the output thereof and allow full motor speed until said close throttle switching means is actuated.

6. The invention as defined in claim 4 wherein said oscillator circuit includes means responsive to the state of said logic means for reducing the duty cycle of the oscillator when the logic means is in one state and for increasing the duty cycle when the logic means is in the other state.

7. The invention as defined in claim 4 wherein said oscillator circuit and said motor are energized by the same voltage source, said oscillator circuit including means for changing the duty cycle of the oscillator circuit in inverse relation to changes in the voltage of the voltage source.

8. In a speed governing system for an engine having a throttle control means, said system being of the type including, a reversible motor adapted to be connected with the throttle control means for actuating the control means selectively in a close throttle direction and open throttle direction, speed sensing means adapted to be connected with said engine for developing a speed voltage corresponding to engine speed, first and second switching means for energizing said motor in the close throttle and open throttle directions respectively, logic means operatively coupled with the sensing means and said switching means for energizing the motor in a close throttle direction when the engine speed exceeds a first predetermined value and for energizing the motor in an open throttle direction when the engine speed is less than said first predetermined value, said system being characterized in that it includes, an oscillator circuit operatively coupled with said logic means for modulating the energization of said motor at the frequency of the oscillator to change the torque of said motor, and control means responsive to a selected opening condition of said system and being coupled with the oscillator circuit for applying the oscillator output to said logic means.

9. The invention as defined in claim 8 wherein said control means is coupled with said logic means and said selected condition is the state of said logic means and wherein said oscillator circuit includes means responsive to the state of said logic means for reducing the duty cycle of the oscillator when the logic means is in one state and for increasing the duty cycle when the logic means is in the other state.

10. The invention as defined in claim 8 wherein said oscillator circuit and said motor are energized by the same voltage source, said oscillator circuit including means for changing the duty cycle of the oscillator circuit in inverse relation to changes in the voltage of the voltage source.

* * * * *